US009097017B1

(12) United States Patent
Vanlennep

(10) Patent No.: US 9,097,017 B1
(45) Date of Patent: Aug. 4, 2015

(54) EASY FIT CONCEALED POST ANCHOR SYSTEM

(71) Applicant: Hector Vanlennep, Fernandina, FL (US)

(72) Inventor: Hector Vanlennep, Fernandina, FL (US)

( * ) Notice: Subject to any disclaimer, the term of this patent is extended or adjusted under 35 U.S.C. 154(b) by 290 days.

(21) Appl. No.: 13/668,277

(22) Filed: Nov. 4, 2012

(51) Int. Cl.
*E04C 3/00* (2006.01)
*E04C 3/34* (2006.01)

(52) U.S. Cl.
CPC ..... *E04C 3/34* (2013.01)

(58) Field of Classification Search
CPC ..... E04B 1/4121; E04H 12/2292
USPC ..... 52/165, 166, 169.13, 170, 698, 699, 52/835, 854; 248/519, 530; 256/65.1, 256/65.14
See application file for complete search history.

(56) References Cited

U.S. PATENT DOCUMENTS 2,763,342 A * 9/1956 French ..... 403/25
3,166,871 A * 1/1965 Simison ..... 206/321
3,241,279 A * 3/1966 Bailey ..... 52/296
3,694,978 A 10/1972 Mintz
4,198,793 A * 4/1980 Sato et al. ..... 52/166
4,642,964 A * 2/1987 Kellison ..... 52/699
5,765,333 A * 6/1998 Cunningham ..... 52/481.1
6,141,928 A * 11/2000 Platt ..... 52/296
6,202,369 B1 3/2001 Partee et al.
6,290,212 B1 * 9/2001 Bartel ..... 256/65.14
6,308,926 B1 * 10/2001 Meyer ..... 248/530
6,343,446 B1 2/2002 Beard
6,367,224 B1 * 4/2002 Leek ..... 52/704
6,390,436 B2 * 5/2002 Barnes et al. ..... 248/548
6,393,795 B1 * 5/2002 Irwin et al. ..... 52/698
6,604,485 B1 8/2003 Hughes, Sr. et al.
6,718,710 B2 * 4/2004 Platt ..... 52/296
6,868,641 B2 * 3/2005 Conner et al. ..... 52/98
6,886,296 B1 * 5/2005 John et al. ..... 52/170
7,455,282 B2 * 11/2008 Platt ..... 256/59
7,530,550 B2 * 5/2009 Fattori ..... 256/65.05
7,637,076 B2 * 12/2009 Vaughn ..... 52/838
7,686,552 B2 * 3/2010 Bohnet et al. ..... 411/82
7,779,589 B2 8/2010 Salman
8,117,798 B2 * 2/2012 Bergman ..... 52/745.17
8,342,485 B2 * 1/2013 McGinness et al. ..... 256/65.14
8,782,978 B1 * 7/2014 Frenette et al. ..... 52/296
8,826,629 B1 * 9/2014 Brindle ..... 52/745.17
2003/0159639 A1 8/2003 Hughes, Sr. et al.
2003/0221385 A1 * 12/2003 Platt ..... 52/296
2004/0128922 A1 * 7/2004 Fearn ..... 52/169.13
2005/0204654 A1 * 9/2005 Fredrickson ..... 52/169.13
2005/0252124 A1 * 11/2005 Bergman ..... 52/296
2006/0065885 A1 * 3/2006 Stanley ..... 256/59
2006/0254195 A1 * 11/2006 Platt ..... 52/736.1
2008/0168740 A1 * 7/2008 Lambdin ..... 52/699
2009/0241467 A1 * 10/2009 Jarvis ..... 52/835
2011/0000166 A1 * 1/2011 Jarvis et al. ..... 52/705

* cited by examiner

*Primary Examiner* — Jeanette E Chapman
*Assistant Examiner* — James Buckle, Jr.
(74) *Attorney, Agent, or Firm* — Richard L Miller

(57) ABSTRACT

A concealed anchor system that installs a post on a support surface. The concealed anchor system includes a stud, a sleeve, and setting material. The stud is attached to the support surface. The setting material is disposed between, and is attached to, the stud and the sleeve. The sleeve is disposed around, and is attached to, the stud, and is received by the post so as to install the post on the support surface. In a first embodiment, the support surface is wood, and in a second embodiment, the support surface is concrete.

28 Claims, 7 Drawing Sheets

EASY FIT CONCEALED POST ANCHOR SYSTEM

1. BACKGROUND OF THE INVENTION

A. Field of the Invention.

The embodiments of the present invention relate to an anchor system, and more particularly, the embodiments of the present invention relate to a concealed anchor system for installing a post on a support surface.

B. Description of the Prior Art.

Numerous innovations for anchor systems have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention.

(1) U.S. Pat. No. 3,694,978 to Mintz.

U.S. Pat. No. 3,694,978 issued to Mintz on Oct. 3, 1972 in U.S. class 52 and subclass 166 teaches a post anchor in the form of spaced, concentrically disposed, and interconnected cylindrical bearing surfaces forming a sturdy reinforcing anchor for elongated post-like members.

(2) U.S. Pat. No. 6,202,369 to Partee et al.

U.S. Pat. No. 6,202,369 issued to Partee et al. on Mar. 20, 2001 in U.S. class 52 and subclass 165 teaches an anchor system for alternate types of signage, which includes an elongated anchor member and an attached and lowermost formation engageable with an underlying foundation to firmly support the anchor member in a substantially vertical disposition. A bore within the anchor member slidably receives the lower portion of an elongated sign pole or marker device, with a stop element within the anchor member serving to limit the length of the sign pole inserted therewithin. Attachment of the sign pole relative the vertical anchor member is achieved by the application of a compression element including a collar and having a tapered inner surface engageable with the upper portion of the anchor member. The inclusion of a plurality of slots in the upper portion of the anchor member provides individual segments that are subsequently deflected radially inwardly upon the tightening of the compression element. Sign poles of lesser diameters may be accommodated with any one anchor member by the insertion of a split sleeve adaptor intermediate the sign pole and anchor member, while altering the height of the anchor member allows attachment of various types and sizes of signage, including signs atop the pole or barricade poles for traffic marking. Various materials may be used for the components, such as metal or nonmetallic, with the latter particularly adaptable for traffic barricades, and wherein the anchor member is of minimal height.

(3) U.S. Pat. No. 6,343,446 to Beard.

U.S. Pat. No. 6,343,446 issued to Beard on Feb. 5, 2002 in U.S. class 52 and subclass 165 teaches a sign post anchor system that provides omni-directional stabilization of a sign post. The anchor system includes a tubular anchor sleeve having a square cross-section for receiving, at one end, the sign post, and at the other end, the tubular post anchor. The anchor sleeve includes a plurality of spaced-apart holes located along the longitudinal axis of the sleeve for permitting selective mounting of the sign post. The anchor sleeve further includes a plurality of fins secured to the cornets of the anchor sleeve, and extending outward from the sleeve. The plurality of fins provide stabilization of the anchor sleeve and accompanying sign post.

(4) U.S. Pat. No. 6,604,485 to Hughes Sr. et al.

U.S. Pat. No. 6,604,485 to Hughes Sr. et al. issued on Aug. 12, 2003 in U.S. class 116 and subclass 209 teaches an anchor system for flexible marker posts, which includes an anchor that receives a post before the anchor is driven into the ground. In a first embodiment, a flat and rectangular plate of mild steel is folded into a U-shape, with parallel upper and lower plates. The lower end of a post is placed within the anchor, and the anchor is driven into the earth with a bladed driver. The anchor bends into a V-shape along an axis defined by the blade of the driver. The anchor retains the post with friction, and the anchor is retained in the earth by mechanical interference and friction. Additional embodiments include plates that are pre-bent into a V-shape, tabs for maintaining separation of the plates, and a one-piece anchor having a V-shaped lower portion and coplanar, horizontal, and upper surfaces connected to the upper edges of the lower portion.

(5) United States Patent Application Publication Number 2003/0159639 to Hughes Sr. et al.

United States Patent Application Publication Number 2003/0159639 published to Hughes Sr. et al. on Aug. 28, 2003 in U.S. class 116 and subclass 209 teaches an anchor system for flexible marker posts, which includes an anchor that receives a post before the anchor is driven into the ground. In one version of the anchor system, a V-shaped configuration folded along two longitudinal side axes and one lower lateral axis. This version has front and rear plates. The rear plate has, and combines with, two flanges to define a narrow pocket that receives the post. The post is secured in the pocket by deforming the pocket with punches. The anchor is retained in the earth by mechanical interference and friction. Additional embodiments include plates that are pre-bent into a V-shape, tabs for maintaining separation of the plates, and a one-piece anchor having a V-shaped lower portion and coplanar, horizontal, and upper surfaces connected to the upper edges of the lower portion.

(6) U.S. Pat. No. 7,779,589 to Salman.

U.S. Pat. No. 7,779,589 issued to Salman on Aug. 24, 2010 in U.S. class 52 and subclass 298 teaches a post anchor/anchor adapter system that is a unitary cast or machined steel or the like. An anchor/adaptor alone is driven alone into a hole cut in in-place concrete. The system includes an anchor extension tube for driving into soft soil. The anchor/adaptor has a body in the form of an elongate square tube having radius-curved corners vertically driven into a round receiving hole, forming creases and a secure anchor. The tube has an upper female portion for a post and a lower female portion for an extender, and is divided by a horizontal plug wall integral with the tube structure. The lower female portion of the anchor/adapter tapers outward towards its lower open end allowing for an interference fit with the driven tube acting as an anchor. The female portion upper end has crescent-shaped tabs defining a disk sized to plug the drilled hole.

It is apparent that numerous innovations for anchor systems have been provided in the prior art, which are adapted to be used. Furthermore, even though these innovations may be suitable for the specific individual purposes to which they address, nevertheless, they would not be suitable for the purposes of the embodiments of the present invention as heretofore described.

2. SUMMARY OF THE INVENTION

Thus, an object of the embodiments of the present invention is to provide a concealed anchor system for installing a post on a support surface, which avoids the disadvantages of the prior art.

Briefly stated, another object of the embodiments of the present invention is to provide a concealed anchor system that installs a post on a support surface. The concealed anchor system includes a stud, a sleeve, and setting material. The stud is attached to the support surface. The setting material is disposed between, and is attached to, the stud and the sleeve. The sleeve is disposed around, and is attached to, the stud, and is received by the post so as to install the post on the support surface. In a first embodiment, the support surface is wood, and in a second embodiment, the support surface is concrete.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

4. LIST OF REFERENCE NUMERALS UTILIZED IN THE FIGURES OF THE DRAWING

A. Introductory of First Embodiment

Figure 1:
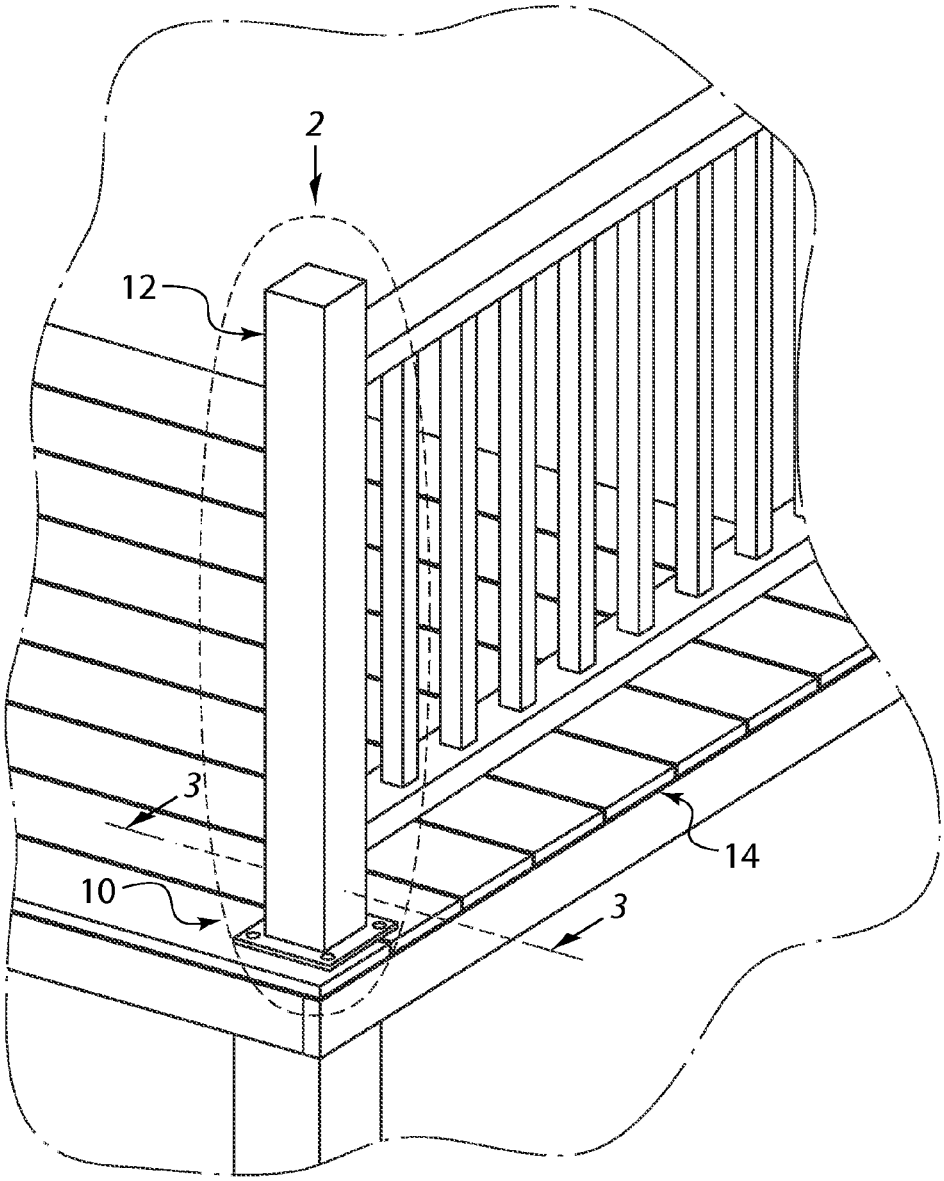
FIG. 1 is a diagrammatic perspective view of a first embodiment of the concealed anchor system of the present invention installing a post on a wood support surface.
Figure 2:
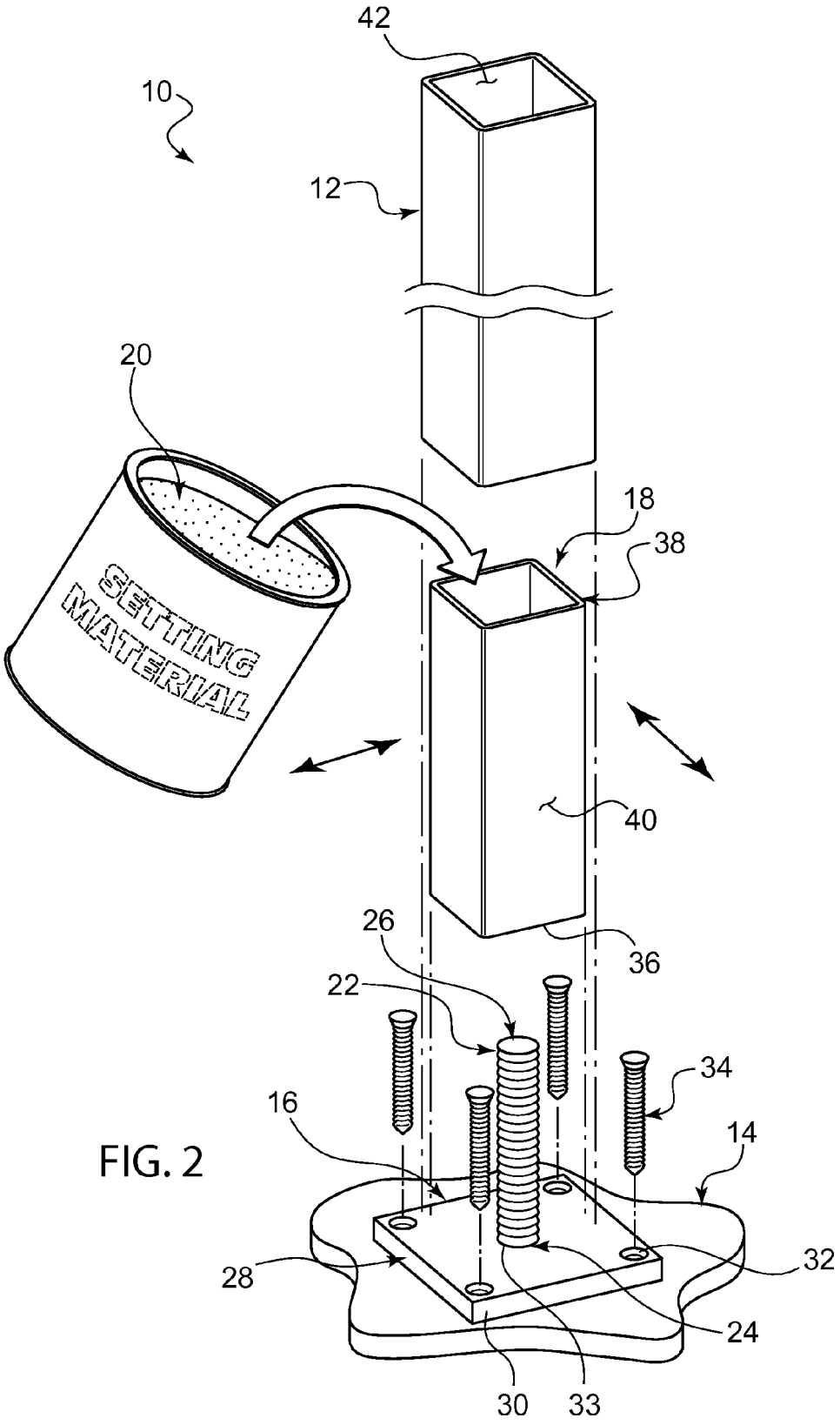
FIG. 2 is an enlarged and exploded diagrammatic perspective view of the area generally enclosed by the dotted curve identified by ARROW 2 in FIG. 1 of the first embodiment of the concealed anchor system of the present invention.

10 first embodiment of concealed anchor system of present invention for installing post
12 on wood support surface 14
12 post
14 wood support surface B. Configuration of First Embodiment of Concealed Anchor System 10.

16 stud for attaching to wood support surface 14
18 sleeve for being received by post 12 so as to install post 12 on wood support surface 14
20 setting material
(1) Stud 16.
22 threaded rod of stud 16
24 proximal end of threaded rod 22 of the stud 16
26 distal end of threaded rod 22 of stud 16
28 base plate of stud 16 for lying flat on wood support surface 14
30 periphery of base plate 28 of stud 16
32 peripheral through bores of base plate 28 of stud 16
33 central through bore of base plate 28 of stud 16
34 lag bolts of stud 16 for passing into wood support surface 14 so as to attach base plate 28 of stud 16, and threaded rod 22 of stud 16 therewith, to wood support surface 14
(2) Sleeve 18.
36 proximal end of sleeve 18
38 distal end of sleeve 18
40 outer surface of sleeve 18
42 inner surface of post 12
44 through bore of sleeve 18
46 through bore of post 18
48 bolt of sleeve 18

C. Introductory of Second Embodiment.

110 second embodiment of concealed anchor system of present invention for installing post 112 on concrete support surface 114
112 post
114 concrete support surface D. Configuration of Second Embodiment of Concealed Anchor System 110.

116 stud for attaching to concrete support surface 114
118 sleeve for being received by post 112 so as to install post 112 on concrete support surface 114
120 setting material
(1) Stud 116.
122 threaded rod of stud 116
124 proximal end of threaded rod 122 of stud 116
126 distal end of threaded rod 122 of stud 116
133 blind bore of concrete support surface 114
134 epoxy of stud 116 for lining bore 133 of concrete support surface 114, between, and attached to, bore 133 of concrete support surface 114 and threaded rod 122 of stud 116 so as to attach threaded rod 122 of stud 116 in concrete supporting surface 114
(2) Sleeve 118.
136 proximal end of sleeve 118
138 distal end of sleeve 118
140 outer surface of sleeve 118
142 inner surface of post 112

5. DETAILED DESCRIPTION OF THE PREFERRED EMBODIMENTS

A. Introductory of a First Embodiment.

Referring now to the figures, in which like numerals indicate like parts, and particularly to FIG. 1, which is a diagrammatic perspective view of a first embodiment of the concealed anchor system of the present invention installing a post on a wood support surface, a first embodiment of the concealed anchor system of the present invention is shown generally at 10 for installing a post 12 on a wood support surface 14.

B. Configuration of the First Embodiment of the Concealed Anchor System 10.

Figure 3:
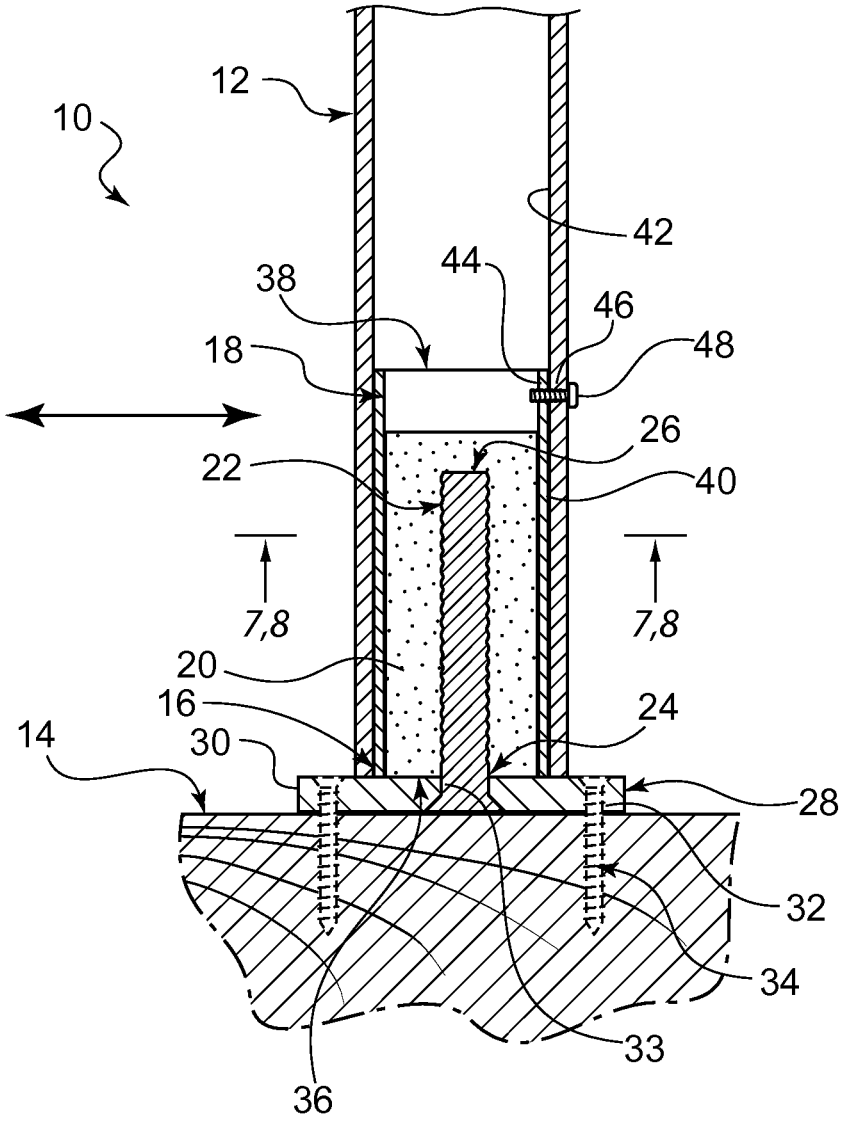
FIG. 3 is an enlarged diagrammatic cross sectional view taken along LINE 3-3 in FIG. 1 of the first embodiment of the concealed anchor system of the present invention.
Figure 6:
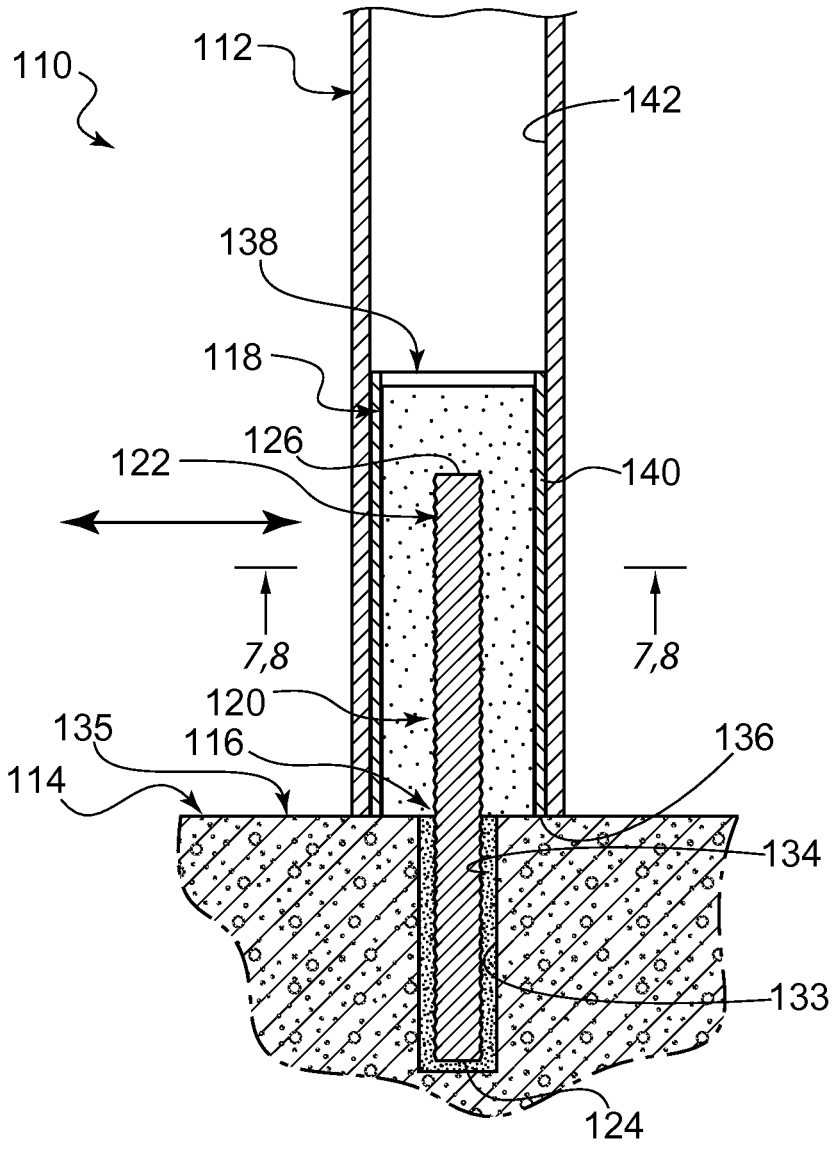
FIG. 6 is an enlarged diagrammatic cross sectional view taken along LINE 6-6 in FIG. 4 of the second embodiment of the concealed anchor system of the present invention.

The configuration of the first embodiment of the concealed anchor system 10 can best be seen in FIGS. 2, 3, 7, and 8, which are, respectively, an enlarged and exploded diagrammatic perspective view of the area generally enclosed by the dotted curve identified by ARROW 2 in FIG. 1 of the first embodiment of the concealed anchor system of the present invention, an enlarged diagrammatic cross sectional view taken along LINE 3-3 in FIG. 1 of the first embodiment of the concealed anchor system of the present invention, an enlarged diagrammatic cross sectional view taken along LINE 7-7 in FIGS. 3 and 6, and an enlarged diagrammatic cross sectional view taken along LINE 8-8 in FIGS. 3 and 6, and as such, will be discussed with reference thereto.

The concealed anchor system 10 comprises a stud 16, a sleeve 18, and setting material 20. The stud 16 is for attaching to the wood support surface 14. The setting material 20 is disposed between, and is attached to, the stud 16 and the sleeve 18. The sleeve 18 is disposed around, and is attached to, the stud 16, and is for being received by the post 12 so as to install the post 12 on the wood support surface 14.

(1) The stud 16.

The stud 16 comprises a threaded rod 22.

The threaded rod 22 of the stud 16 is vertically oriented, slender, elongated, and has a proximal end 24 and a distal end 26.

The proximal end 24 of the threaded rod 22 of the stud 16 is downwardly flaring.

The stud 16 further comprises a base plate 28.

The base plate 28 of the stud 16 is flat, and is for lying flat on the wood support surface 14.

The base plate 28 of the stud 16 has a periphery 30 and peripheral through bores 32. The peripheral through bores 32 of the base plate 28 of the stud 16 are disposed through the periphery 30 of the base plate 28 of the stud 16.

The base plate 28 of the stud 16 further has a central through bore 33.

The central through bore 33 of the base plate 28 of the stud 16 is downwardly flaring.

The threaded rod 22 of the stud 16 is disposed in, and extends upwardly from, the central through bore 33 of the base plate 28 of the stud 16, with the central through bore 33 of the base plate 28 of the stud 16 capturing the proximal end 24 of the threaded rod 22 of the stud 16 so as to prevent the threaded rod 22 of the stud 16 from being pulled upwardly out of the central through bore 33 of the base plate 28 of the stud 16.

The stud 16 further comprises lag bolts 34.

The lag bolts 34 of the stud 16 pass through the peripheral through bores 32 of the base plate 28 of the stud 16, and are for passing into the wood support surface 14 so as to attach the base plate 28 of the stud 16, and the threaded rod 22 of the stud 16 therewith, to the wood support surface 14.

(2) The sleeve 18.

The sleeve 18 is hollow, slender, and elongated.

The sleeve 18 has a proximal end 36 and a distal end 38. The sleeve 18 extends vertically upwardly from the base plate 28 of the stud 16, with the proximal end 36 of the sleeve 18 resting on the base plate 28 of the stud 16, and with the distal end 38 of the sleeve 18 being past the distal end 26 of the threaded rod 22 of the stud 16.

The sleeve 18 further has an outer surface 40, and the post 12 has an inner surface 42. The outer surface 40 of the sleeve 18 and the inner surface 42 of the post 12 are of such dimensions and shape that the post 12 snugly receives the sleeve 18.

The sleeve 18 and the post 12 are of any shape so long as the post 12 snugly receives the sleeve 18.

The sleeve 18 further comprises a through bore 44, in proximity to the distal end 38 of the sleeve 18, and the post 18 has a through bore 46.

The through bore 44 of the sleeve 18 and the through bore 46 of the post 18 are laterally aligned with each other.

The sleeve 18 further comprises a bolt 48.

The bolt 48 of the sleeve 18 passes through the through bore 46 of the post 12 and the through bore 44 of the sleeve 18 to thereby attach the post 12 to the sleeve 18.

(3) the Setting Material 20.

The setting material 20 is sold by, for example, Mapei Corporation, and TEC Incorporated.

Figure 7:
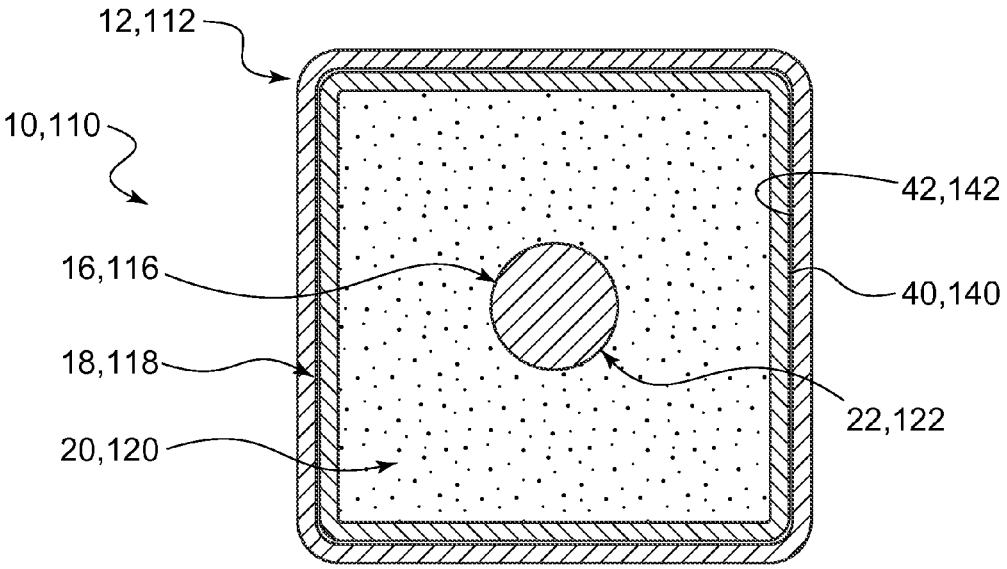
FIG. 7 is an enlarged diagrammatic cross sectional view taken along LINE 7-7 in FIGS. 3 and 6.
Figure 8:
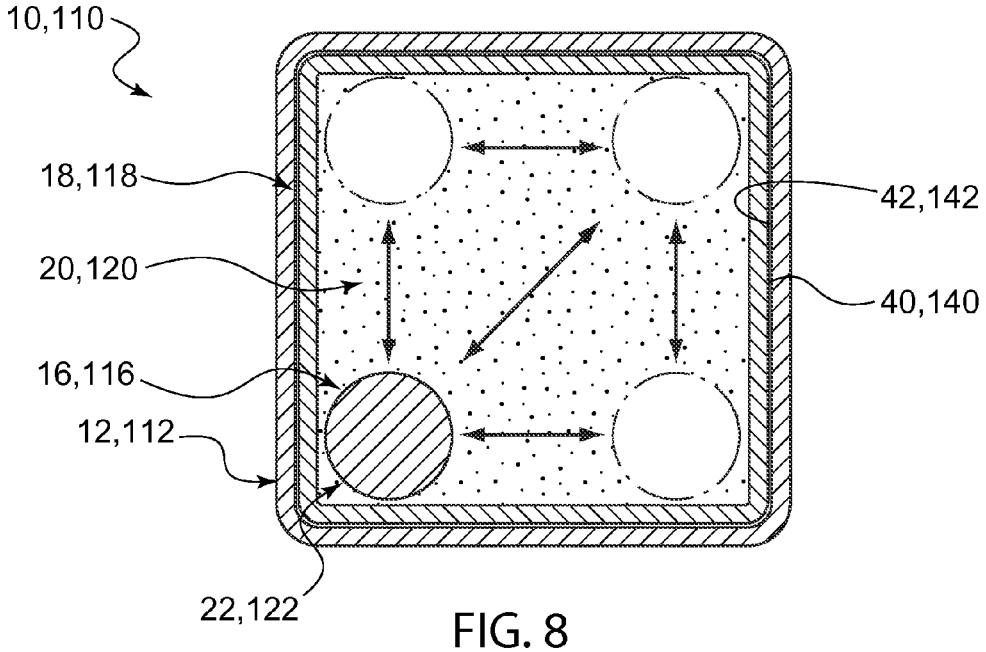
FIG. 8 is an enlarged diagrammatic cross sectional view taken along LINE 8-8 in FIGS. 3 and 6.

The setting material 20 fills the sleeve 18, but, as shown in FIGS. 7 and 8, respectively, because the setting material 20 is workable before it sets, the sleeve 18 can be positioned either coaxial with the threaded rod 22 of the stud 16 or can be moved sideways relative to the threaded rod 22 of the stud 16 to be positioned offset for adjusting for proper positioning of the post 12.

C. Introductory of a Second Embodiment.

Figure 4:
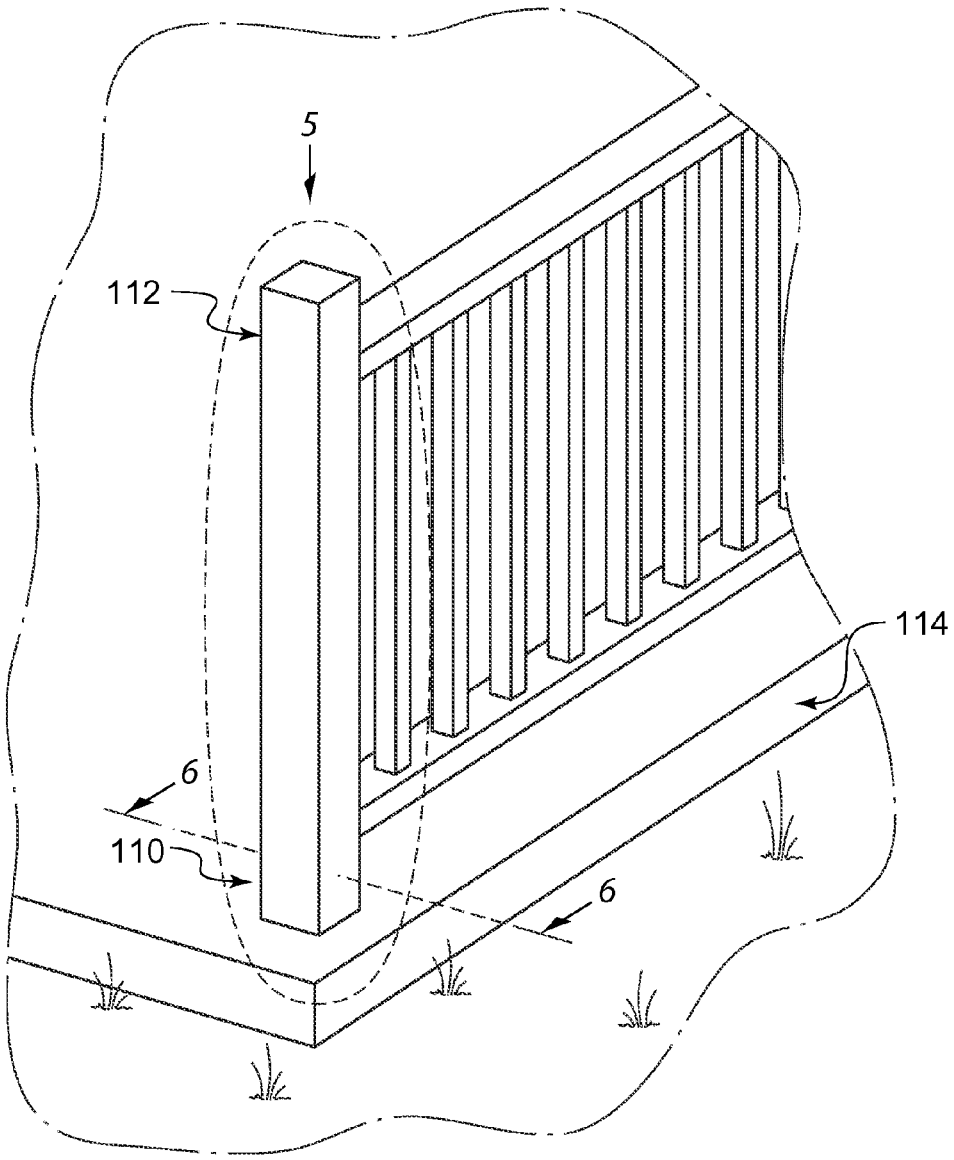
FIG. 4 is a diagrammatic perspective view of a second embodiment of the concealed anchor system of the present invention installing a post on a concrete support surface.

Referring now to FIG. 4, which is a diagrammatic perspective view of a second embodiment of the concealed anchor system of the present invention installing a post on a concrete support surface, a second embodiment of the concealed anchor system of the present invention is shown generally at 110 for installing a post 112 on a concrete support surface 114.

D. Configuration of the Second Embodiment of the Concealed Anchor System 110.

Figure 5:
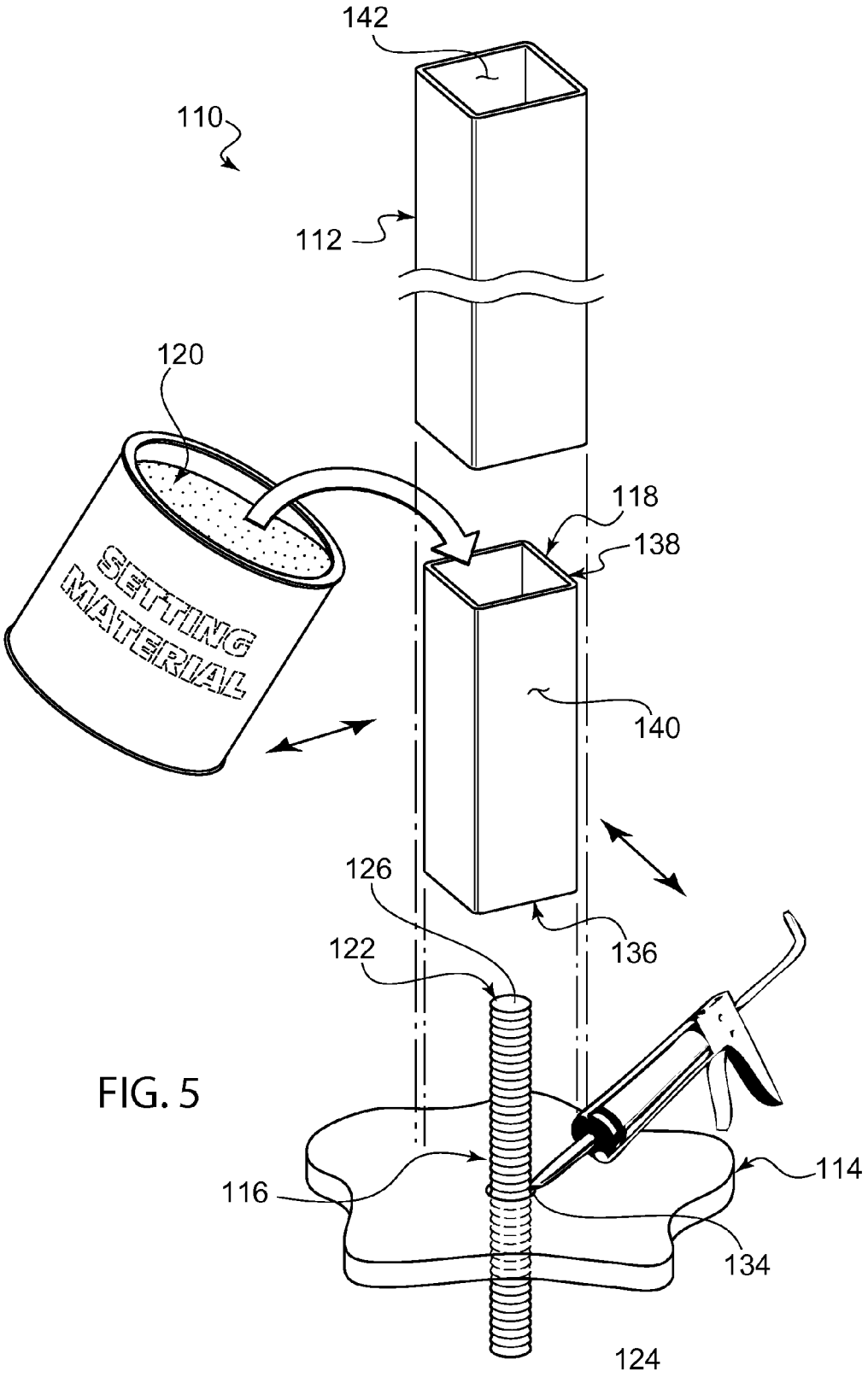
FIG. 5 is an enlarged and exploded diagrammatic perspective view of the area generally enclosed by the dotted curve identified by ARROW 5 in FIG. 4 of the second embodiment of the concealed anchor system of the present invention.

The configuration of the second embodiment of the concealed anchor system 110 can best be seen in FIGS. 5, 6, 7, and 8, which are, respectively, an enlarged and exploded diagrammatic perspective view of the area generally enclosed by the dotted curve identified by ARROW 5 in FIG. 4 of the second embodiment of the concealed anchor system of the present invention, an enlarged diagrammatic cross sectional view taken along LINE 6-6 in FIG. 4 of the second embodiment of the concealed anchor system of the present invention, again, an enlarged diagrammatic cross sectional view taken along LINE 7-7 in FIGS. 3 and 6, and, again, an enlarged diagrammatic cross sectional view taken along LINE 8-8 in FIGS. 3 and 6, and as such, will be discussed with reference thereto.

The concealed anchor system 110 comprises a stud 116, a sleeve 118, and setting material 120. The stud 116 is for attaching to the concrete support surface 114. The setting material 120 is disposed between, and is attached to, the stud 116 and the sleeve 118. The sleeve 118 is disposed around, and is attached to, the stud 116, and is for being received by the post 112 so as to install the post 112 on the concrete support surface 114.

(1) the Stud 116.

The stud 116 comprises a threaded rod 122.

The threaded rod 122 of the stud 116 is vertically oriented, slender, elongated, and has a proximal end 124 and a distal end 126.

The threaded rod 122 of the stud 116 is disposed in, and extends upwardly from within, a blind bore 133 of the concrete support surface 114.

The stud 116 further comprises epoxy 134.

The epoxy 134 of the stud 116 is for lining the blind bore 133 of the concrete support surface 114, between, and attached to, the blind bore 133 of the concrete support surface 114 and the threaded rod 122 of the stud 116 so as to attach the threaded rod 122 of the stud 116 in the concrete support surface 114.

(2) the Sleeve 118.

The sleeve 118 is hollow, slender, and elongated.

The sleeve 118 has a proximal end 136 and a distal end 138. The sleeve 118 is for extending vertically upwardly from the concrete support surface 114, with the proximal end 136 of the sleeve 118 resting on the concrete support surface 114, and with the distal end 138 of the sleeve 118 being past the distal end 126 of the threaded rod 122 of the stud 116.

The sleeve 118 further has an outer surface 140, and the post 112 has an inner surface 142. The outer surface 140 of the sleeve 118 and the inner surface 142 of the post 112 are of such dimensions and shape that the post 112 snugly receives the sleeve 118.

The sleeve 118 and the post 112 are of any shape so long as the post 112 snugly receives the sleeve 118.

(3) the Setting Material 120.

The setting material 120 is sold by, for example, Mapei Corporation, and TEC Incorporated.

The setting material 120 fills the sleeve 118, but, as shown in FIGS. 7 and 8, respectively, because the setting material 120 is workable before it sets, the sleeve 118 can be positioned either coaxial with the threaded rod 122 of the stud 116 or can be moved sideways relative to the threaded rod 122 of the stud 116 to be positioned offset for adjusting for proper positioning of the post 112.

E. Impressions.

It will be understood that each of the elements described above or two or more together may also find a useful application in other types of constructions differing from the types described above.

While the embodiments of the present invention have been illustrated and described as embodied in a concealed anchor system for installing a post on a support surface, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A concealed anchor system for installing a post on a wood support surface, comprising:

a) a stud;

b) a sleeve; and c) setting material;

wherein said stud is for attaching to the wood support surface;

wherein said setting material is disposed between said stud and said sleeve;

wherein said setting material is attached to said stud and said sleeve;

wherein said sleeve is disposed around said stud;

wherein said sleeve is attached to said stud;

wherein said sleeve is for being received by the post so as to install the post on the wood support surface;

wherein said stud comprises a rod;

wherein said rod of said stud is entirely externally threaded; and wherein said sleeve is positioned non-coaxially with said threaded rod of said stud.

2. The concealed anchor system of claim 1, wherein said threaded rod of said stud is vertically oriented;

wherein said threaded rod of said stud is slender;

wherein said threaded rod of said stud is elongated; and wherein said threaded rod of said stud has:

a) a proximal end; and b) a distal end.

3. The concealed anchor system of claim 2, wherein said proximal end of said threaded rod of said stud is downwardly flaring.

4. The concealed anchor system of claim 2, wherein said stud comprises a base plate.

5. The concealed anchor system of claim 4, wherein said base plate of said stud is flat; and wherein said base plate of said stud is for lying flat on the wood support surface.

6. The concealed anchor system of claim 4, wherein said base plate of said stud has:

a) a periphery; and b) peripheral through bores; and wherein said peripheral through bores of said base plate of said stud are disposed through said periphery of said base plate of said stud.

7. The concealed anchor system of claim 4, wherein said base plate of said stud has a central through bore.

8. The concealed anchor system of claim 7, wherein said central through bore of said base plate of said stud is downwardly flaring.

9. The concealed anchor system of claim 7, wherein said threaded rod of said stud is disposed in said central through bore of said base plate of said stud; and wherein said threaded rod of said stud extends upwardly from said central through bore of said base plate of said stud.

10. The concealed anchor system of claim 7, wherein said central through bore of said base plate of said stud captures said proximal end of said threaded rod of said stud so as to prevent said threaded rod of said stud from being pulled upwardly out of said central through bore of said base plate of said stud.

11. The concealed anchor system of claim 6, wherein said stud comprises lag bolts.

12. The concealed anchor system of claim 11, wherein said lag bolts of said stud pass through said peripheral through bores of said base plate of said stud, and are for passing into the wood support surface so as to attach said base plate of said stud, and said threaded rod of said stud therewith, to the wood support surface.

13. The concealed anchor system of claim 1, wherein said sleeve is hollow;

wherein said sleeve is slender; and wherein said sleeve is elongated.

14. The concealed anchor system of claim 4, wherein said sleeve has:

a) a proximal end; and b) a distal end;

wherein said sleeve extends vertically upwardly from said base plate of said stud;

wherein said proximal end of said sleeve rests on said base plate of said stud; and wherein said distal end of said sleeve is past said distal end of said threaded rod of said stud.

15. The concealed anchor system of claim 1, wherein said sleeve has an outer surface;

wherein the post has an inner surface; and wherein said outer surface of said sleeve and the inner surface of the post are of such dimensions and shape that the post snugly receives said sleeve.

16. The concealed anchor system of claim 14, wherein said sleeve comprises a through bore.

17. The concealed anchor system of claim 16, wherein said through bore of said sleeve is in proximity to said distal end of said sleeve.

18. The concealed anchor system of claim 16, wherein the post has a through bore; and wherein said through bore of said sleeve and the through bore of the post are laterally aligned with each other.

19. The concealed anchor system of claim 16, wherein said sleeve comprises a bolt.

20. The concealed anchor system of claim 19, wherein said bolt of said sleeve passes through the through bore of the post and said through bore of said sleeve to thereby attach the post to said sleeve.

21. A concealed anchor system for installing a post on a concrete support surface, comprising:

a) a stud;

b) a sleeve; and c) setting material;

wherein said stud is for attaching to the concrete support surface;

wherein said setting material is disposed between said stud and said sleeve;

wherein said setting material is attached to said stud and said sleeve;

wherein said sleeve is disposed around said stud;

wherein said sleeve is attached to said stud; and wherein said sleeve is for being received by the post so as to install the post on the concrete support surface;

wherein said stud comprises a rod;

wherein said rod of said stud is entirely externally threaded; and wherein said sleeve is positioned non-coaxially with said threaded rod of said stud.

22. The concealed anchor system of claim 21, wherein said threaded rod of said stud is vertically oriented;

wherein said threaded rod of said stud is slender;

wherein said threaded rod of said stud is elongated; and wherein said threaded rod of said stud has:

a) a proximal end; and b) a distal end.

23. The concealed anchor system of claim 22, wherein said threaded rod of said stud is disposed in a blind bore of the concrete support surface; and wherein said threaded rod of said stud extends upwardly from within the blind bore of the concrete support surface.

24. The concealed anchor system of claim 23, wherein said stud comprises epoxy.

25. The concealed anchor system of claim 24, wherein said epoxy of said stud is for lining the blind bore of the concrete support surface;

wherein said epoxy of said stud is disposed between the blind bore of the concrete support surface and said threaded rod of said stud; and wherein said epoxy of said stud is attached to the blind bore of the concrete support surface and said threaded rod of said stud so as to attach said threaded rod of said stud in the concrete support surface, with said proximal end of said threaded rod of said stud being below ground level.

26. The concealed anchor system of claim 21, wherein said sleeve is hollow;

wherein said sleeve is slender; and wherein said sleeve is elongated.

27. The concealed anchor system of claim 22, wherein said sleeve has:

a) a proximal end; and b) a distal end;

wherein said sleeve is for extending vertically upwardly from the concrete support surface;

wherein said proximal end of said sleeve rests on the concrete support surface; and wherein said distal end of said sleeve is past said distal end of said threaded rod of said stud.

28. The concealed anchor system of claim 21, wherein said sleeve has an outer surface;

wherein the post has an inner surface; and wherein said outer surface of said sleeve and said inner surface of said post are of such dimensions and shape that the post snugly receives said sleeve.

* * * * *